US006009822A

United States Patent [19]

Aron

[11] Patent Number: 6,009,822

[45] Date of Patent: Jan. 4, 2000

[54] BOW OR STERN THRUSTER

[76] Inventor: Douglas A. Aron, Shipwrights Inc., 855 Worcester Rd., Framingham, Mass. 01701

[21] Appl. No.: 09/280,063

[22] Filed: Mar. 29, 1999

[51] Int. Cl.[7] ..... B63H 25/46

[52] U.S. Cl. ..... 114/151; 440/38; 440/49; 416/244 B

[58] Field of Search ..... 114/148, 151; 416/155, 157 R, 158, 204 R, 244 RB, 244 B; 440/38, 49

[56] References Cited

U.S. PATENT DOCUMENTS

| | | | |
|---|---|---|---|
| 598,424 | 2/1898 | Kuss . | |
| 1,288,106 | 12/1918 | Medynski . | |
| 2,699,138 | 1/1955 | Dyer . | |
| 3,127,865 | 4/1964 | Pleuger | 114/148 |
| 3,185,122 | 5/1965 | Pleuger | 114/151 |
| 3,550,547 | 12/1970 | Pleuger et al. | 114/151 |
| 3,903,833 | 9/1975 | Lais et al. | 114/151 |
| 3,918,389 | 11/1975 | Shima | 114/151 |
| 3,970,027 | 7/1976 | Jackson | 114/151 |
| 4,074,652 | 2/1978 | Jackson | 114/151 |
| 4,147,125 | 4/1979 | Slade | 114/151 |
| 4,175,511 | 11/1979 | Krautkremer | 114/151 |
| 4,278,431 | 7/1981 | Krautkremer et al. | 114/151 |
| 4,411,630 | 10/1983 | Krautkremer et al. | 114/151 |
| 4,412,500 | 11/1983 | Krautkremer | 114/151 |
| 4,419,082 | 12/1983 | Krautkremer et al. | 114/151 |
| 4,838,821 | 6/1989 | Krautkremer | 114/151 |
| 5,146,865 | 9/1992 | Lais et al. | 114/151 |
| 5,336,119 | 8/1994 | Lais et al. | 114/151 |

FOREIGN PATENT DOCUMENTS

| | | |
|---|---|---|
| 1130378 | 10/1968 | United Kingdom . |
| 1189779 | 4/1970 | United Kingdom . |

*Primary Examiner*—Jesus D. Sotelo
*Attorney, Agent, or Firm*—Richard C. Litman

[57] ABSTRACT

The bow or stern thruster is a steering device for commercial boats or for large yachting vessels. The thruster has a tunnel disposed transversely across either the bow or the stern of the boat. The tunnel has a tunnel flange secured to an opening in the tunnel. A multisection gearbox including a flange, a neck, a foot cap, and a hollow, cylindrical foot is mounted on the tunnel flange with the foot extending into the interior of the tunnel, being suspended by the neck. The gearbox houses a vertical gear shaft extending through the neck into the foot, which drives a pair of horizontal shafts extending through the foot in opposite directions by a spiral bevel gear coupling. The ends of the horizontal shaft are hollow and have a keyway defined therein. The horizontal shafts each receive a propeller integral with a keyed propeller shaft. The propellers rotate in opposite directions. The vertical shaft is driven by a motor or engine housed within the vessel, but outside the tunnel. A pair of screens having a cloverleaf formation are mounted within the tunnel on opposite sides of the propellers.

19 Claims, 10 Drawing Sheets

BOW OR STERN THRUSTER

BACKGROUND OF THE INVENTION

1. Field of the Invention

The present invention relates to boats, and particularly to a bow or stern thruster for commercial boats, such as fishing boats, ferries, etc., as well as for large yachts, which provides a propulsion means for steering the boat in docking maneuvers, or for maintaining the boat's position against strong winds and/or current, commonly called "dynamic positioning. The thrusters also allow barges to make tighter turns in rivers.

2. Description of the Related Art

Some boats or vessels are equipped with a bow or stern thruster as a supplemental means of propulsion for steering purposes, since the boat's response to the rudder may be slow. The conventional thruster comprises either a single or double screw propeller disposed in a tunnel aligned transversely through either the bow or the stern of the vessel. In constructing a bow or stern thruster, it is advantageous to construct the tunnel with as small a diameter as possible. The small diameter has the advantage of: reducing the dead load caused by the volume of water which fills the tunnel, thereby improving fuel economy; since the diameter of the tunnel is smaller, the aft wall of the tunnel presents a smaller resistance to the flow of water when the vessel is in motion; allows placement further forward in the hull, increasing the moment arm produced by the thruster, reducing tunnel length which further reduces the dead load; allows placement in shallow draft vessels; requires less submergence; and allows the tunnel to fit in vessels which have narrowly spaced structural ribs in the hull without the necessity for expensive structural alterations in the hull.

This object may be achieved by developing the maximum horsepower attainable in the smallest practicable drive mechanism. The amount of horsepower developed depends upon the size of the gears used to transmit power from the drive shaft to the propeller shafts. Generally, the larger the gear, the larger the horsepower developed to steer the vessel, but larger gears sizes have also required larger gearbox housings and larger tunnels.

The efficiency of the bow or stern thruster may also be improved by providing a gearbox and its supporting apparatus with a narrow profile to present less resistance to the flow of water through the tunnel, effectively increasing water flow without increasing tunnel size.

A further consideration involves the necessity for maintenance on the thruster unit. Conventional thruster gear box units have a shaft extending from one or both sides of the gearbox housing on which propeller hubs may be mounted. Thruster units, as with all machinery, require oiling or lubrication from time to time, and being exposed to the water, they may requiring painting as protection from corrosion periodically. Conventional gearbox construction may require drydocking for a week or more in order to perform maintenance services. A gearbox design allowing removal of the thruster unit from the tunnel while the boat is still in the water would be desirable.

A variety of bow or stern thruster devices and related propulsion devices are known in the art. U.S. Pat. No. 598,424, issued Feb. 1, 1898 to W. Kuss, describes a pair of propellers mounted on a shaft in a passage extending transversely across the ship. The propeller shaft is driven by a drive shaft coupled to the crankshaft of the main engine by bevel gearing. U.S. Pat. No. 1,288,106, issued Dec. 17, 1918 to F. V. Medynski, discloses an arcuate tube extending across the stern of a vessel, a motor in the engine room being situated in the bend of the tubing and being coupled to shafts extending in opposite directions through packing glands in the walls of the tube. Propellers are mounted on the ends of the shafts, the shafts being supported by bearings suspended from the walls of the tube by radial arms.

U.S. Pat. No. 2,699,138, issued Jan. 11, 1955 to H. B. Dyer, teaches a steering apparatus for a barge having a vertical housing extending from the deck through the skeg of the barge, the housing having a transverse port in which a gearbox with a single propeller is disposed. U.S. Pat. No. 3,127,865, issued Apr. 7, 1964 to F. W. Pleuger, shows a propulsion unit in a transverse duct in the bow of a vessel in which tandem propellers are operated at different speeds by a differential. U.S. Pat. No. 3,185,122, issued May 25, 1965, also to Pleuger, shows a streamlined casing mounted in a tube extending transversely through the ship, the casing being supported by hollow struts, the casing housing propeller shafts driven by a chain and sprocket assembly, the chain being partially disposed in the hollow struts.

U.S. Pat. No. 3,550,547, issued Dec. 29, 1970 to Pleuger, et al., teaches a bow thruster which may be used for main propulsion when the main engine is damaged. The thruster is mounted in a tube which is used for steering when retracted, but which may be extended below the ship and rotated in any direction to drive the ship. U.S. Pat. No. 3,970,027, issued Jul. 20, 1976 to W. M. Jackson, describes a device for "priming" bow steering pumps in barges. A filter pump drives a shaft with dual propellers disposed in a tube extending transversely through the bow and sloping downwards at the sides to form nozzles. The devices includes a vacuum pump and tubing with air and water inlets to overcome the vacuum effect caused by water rushing out the nozzle. U.S. Pat. No. 4,074,652, issued Feb. 21, 1978, also to Jackson, shows a transverse tube mounted on a rotatable shaft for steering a barge in any direction.

U.S. Pat. No. 3,903,833, issued Sep. 9, 1975 to Lais et al., shows a propulsion device for shallow draft vessels having a trough in the stern. The device has a vertically mounted propeller which draws water upward and out through elbow shaped tunnels at the sides. U.S. Pat. No. 3,918,389, issued Nov. 11, 1975 to K. Shima, discloses a turbine propulsion device with a worm wheel connected to a steering device. U.S. Pat. No. 4,147,125, issued Apr. 3, 1979 to O. G. Slade, teaches propulsion machinery mounted vertically in the hull which takes water in and expels it in a jet to propel the vessel. Steering is accomplished by ring and pinion gears which direct output baffles as desired.

U.S. Pat. No. 4,175,511, issued to F. Krautkremer, describes; propulsion machinery for tugboats which includes twin propellers on separate shafts with separate drive machinery, the propellers extending below the hull and being rotatable through 360°. U.S. Pat. No. 4,278,431, issued Jul. 14, 1981 to Krautkremer, et al., shows a hydro-jet propulsion device for flat-bottomed watercraft having a rotatable tube with an elbow shape, a propeller eccentrically mounted in the input port of the elbow, the input and output ports being on the bottom of the watercraft.

U.S. Pat. No. 4,411,630, issued Oct. 25, 1983, also to Krautkremer, et al., shows an improvement to the '431 device which includes a port and passage for air into the outlet leg of the elbow in order to drive the water jet downward instead of allowing it to flow under and parallel to the hull. U.S. Pat. No. 4,412,500, issued Nov. 1, 1983, also to Krautkremer, shows an arrangement for controlling the speed of a bow or stern thruster driven by a hydraulic motor mechanically linked to the main engine which uses a feedback circuit to control the speed of the hydraulic motor.

U.S. Pat. No. 4,419,082, issued Dec. 6, 1983 to Krautkremer, et al., teaches a water-jet drive mechanism for driving and controlling a shallow draft vessel which has a cylindrical housing containing a centrifugal pump with a spiral housing, the pump being inclined at an angle. U.S. Pat. No. 4,838,821, issued Jun. 13, 1989, also to Krautkremer, improves the '082 device by a ring connecting the blades of the pump to prevent damage to the blades of the pump in lieu of a screen.

U.S. Pat. No. 5,146,865, issued Sep. 15, 1992 to Lais, et al. describes a pot-pump propulsion system for flat bottom boats. U.S. Pat. No. 5,336,119, issued Aug. 9, 1994, also to Lais, et al., teaches a low emission drive unit for light watercraft using an electric motor to drive a belt-driven propeller shaft.

U.K. Patent No. 1,130,378, published Oct. 16, 1968, shows a bow thruster with transverse inlet tubes feeding a vertical shaft having a venturi tube leading to an impeller and narrowing to a nozzle. The nozzle emits a jet transversely. In a retracted position, the nozzle may eject to either side for low speed maneuvering. The nozzle may also be extended below the keel and rotated 360° for maneuvering on the open sea. U.K. Patent No. 1,189,779, published Apr. 29, 1970, shows a bow thruster mounted in a tube transverse to the axis of the vessel with an impeller driven by an electric motor through bevel gearing, the outlet of the impeller being narrowed to form a nozzle emitting a jet. The impeller is supported by vanes and has a wide nose on the inlet side and a bullet shape on the outlet side. The device includes a worm gear to rotate the impeller 180° to change the direction of thrust.

None of the above inventions and patents, taken either singularly or in combination, is seen to describe the instant invention as claimed. Thus a bow or stern thruster solving the aforementioned problems is desired.

SUMMARY OF THE INVENTION

The bow or stern thruster is a steering device for commercial boats or for large yachting vessels. The thruster has a tunnel disposed transversely across either the bow or the stern of the boat, either within the hull or external to the hull. The tunnel has a tunnel flange secured to an opening in the tunnel. A multisection gearbox including a flange, a neck, a foot cap, and a hollow, cylindrical foot is mounted on the tunnel flange with the foot extending into the interior of the tunnel, being suspended by the neck. The gearbox houses a vertical gear shaft extending through the neck into the foot, which drives a pair of horizontal shafts extending through the foot in opposite directions by a spiral bevel gear coupling. The ends of the horizontal shaft are hollow and have a keyway defined therein. The horizontal shafts each receive a propeller integral with a keyed propeller shaft. The propellers rotate in opposite directions. The vertical shaft is driven by a motor or engine housed within the vessel, but outside the tunnel. A pair of screens having a cloverleaf formation are mounted within the tunnel on opposite sides of the propellers.

Conventional thrusters are assembled by inserting the vertical drive shaft through the neck into the foot. Consequently, the neck of a conventional thruster is usually cylindrical and has a relatively large diameter to accommodate a gear able to supply enough horsepower to steer a commercial vessel, which may have a length of between about one hundred to one hundred and seventy five feet. The large diameter of the neck increases resistance to the flow of water through the tunnel, decreasing the efficiency of the thruster. Advantageously, the neck of the gearbox of the present invention has a pair of elongated, rectangular side walls and a pair of narrow, arcuately shaped end walls, the cavity defined within the neck having a width only slightly greater than the diameter of the vertical shaft. The narrow end walls are directed towards opposite ends of the tunnel, providing a decreased resistance to the flow of water through the tunnel.

The narrow width of the gearbox neck is made possible by modular construction of the gearbox. The gears are assembled through an opening in the foot. The foot cap is then placed over the shaft of the vertical gear and forms a watertight seal against the foot. The neck is then placed over the shaft of the vertical gear atop the foot cap, and the gearbox flange is mounted over the neck. The gearbox is then inserted through the opening in the tunnel flange and secured to the flange. In this manner, the thruster has gears large enough to deliver a large horsepower in a compact gearbox unit. The thruster of the present invention is able to deliver a minimum of one hundred fifty horsepower up to a maximum of 200 horsepower in a sixteen inch diameter tunnel, a power advantage between three to four times greater than conventional thrusters of comparable size. Due to the modular design, the neck can be easily altered in length to allow retrofitting to any size tunnel less than twenty-four inches in diameter.

The propeller shafts are integral with the propeller hubs. The propeller shafts are inserted into the hollow ends of the horizontal gear shafts. No gear shafts or propeller shafts extend from the ends of the foot of the gearbox. This construction permits the foot of the gearbox to be shorter than conventional gearboxes. The propellers, which typically way as much as the, assembled gear box, may be removed from the horizontal shafts, leaving a compact, relatively light weight gearbox which may be removed through the tunnel flange for maintenance while the vessel is still in the water.

Accordingly, it is a principal object of the invention to provide a thruster disposed in the bow or stern of a boat in which the tunnel running transversely across the bow or stern of the vessel may be made of comparatively small diameter due to the compact profile of the gearbox in relation to the power delivered, to the propeller shafts.

It is another object of the invention to provide a bow or stern thruster having a gearbox of decreased length by a unique propeller shaft to gear shaft arrangement in which no shafts extend from the foot of the gearbox.

It is a further object of the invention to provide a bow or stern thruster in which the vessel has less time out of service for maintenance due to a uniquely designed tunnel flange which permits removal of the gearbox while the vessel is still in the water.

Still another object of the invention is to provide a bow or stern thruster with an improved stator screen to prevent damage to the thruster from debris entering the tunnel, as well as functioning as stators to straighten the flow of water from the propellers, converting rotational energy to a lateral thrust.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
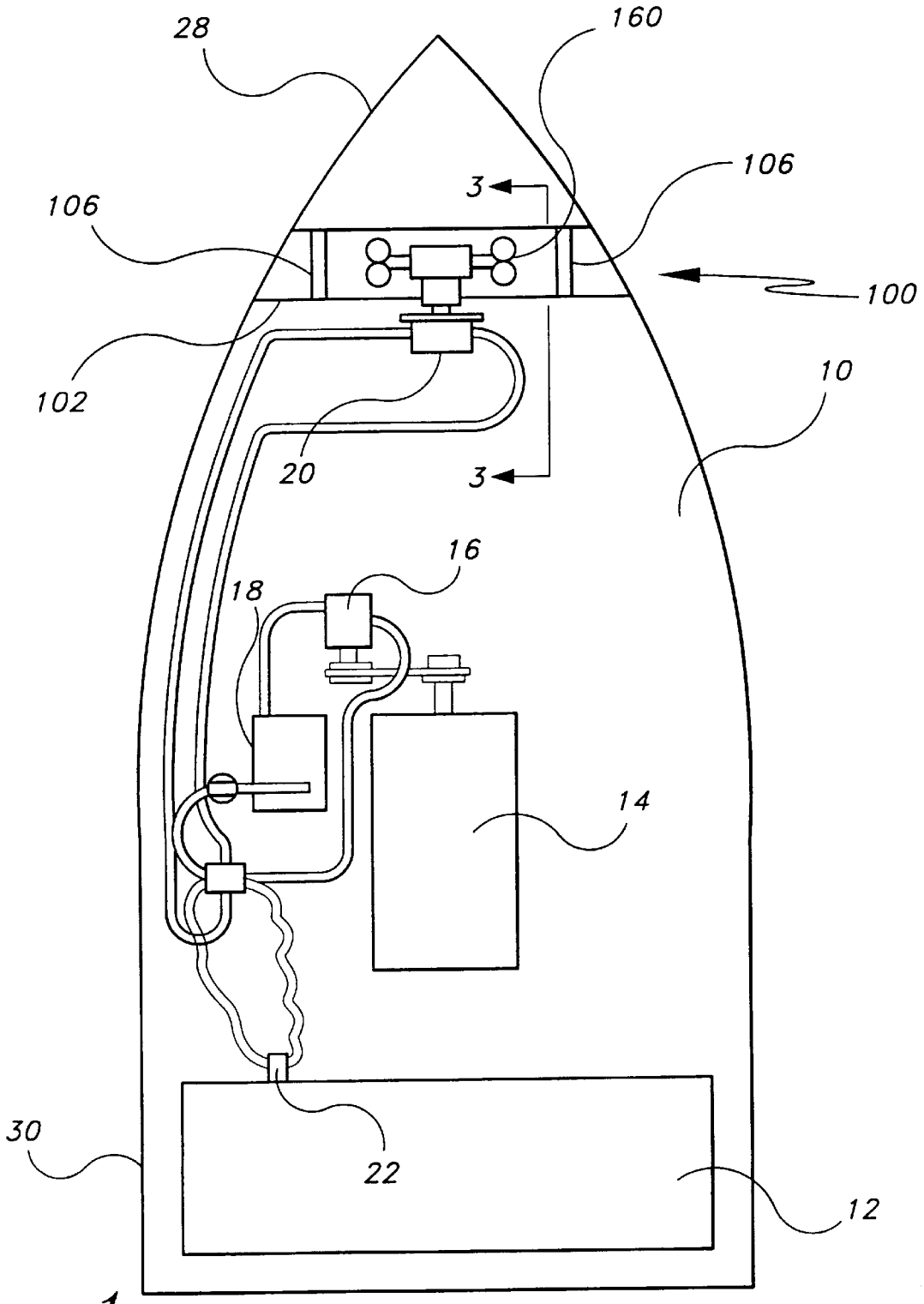
FIG. 1 is a schematic, plan view of a boat equipped with a bow thruster according to the present invention.

The present invention is a bow or stern thruster, designated generally as 100 in the drawings, which serves as an auxiliary steering aide in a boat or other waterborne vessel. The installation of the thruster 100 is shown schematically in the bow 28 of a boat 10 in FIG. 1. It will be understood that the thruster 100 may be installed in the stern 30 of the boat 10, or in both the bow 28 and the stern 30. In FIG. 1, the cockpit area is indicated generally at 12 and the main engine at 14. Although the thruster 100 may be driven by the main engine 14, preferably the thruster 100 is driven by a hydraulic motor or an electric motor. FIG. 1 schematically depicts a hydraulic motor 20, supplied by a hydraulic pump 16 and reservoir 18, and controlled by a remote control 22 from the cockpit 12. Since a belt driven hydraulic pump cannot reach the power levels needed for the thruster 100, the hydraulic pump 16 is driven off the crankshaft of the main engine 14. Such hydraulic systems for boats are well known in the art, and will not further be described.

The thruster 100 includes a pair of counterrotating propellers 160 driven by a motor 20, which are disposed in a cylindrical pipe 102 defining a tunnel 104 transversely across either the bow 28 or stern 30 of the vessel. Although the thruster 100 is shown extending through the hull in the drawings, it will be understood that the pipe 102 may be disposed across the bow or stern external to the hull, as is well known in the art. The pipe 102 may be made from any corrosion resistant material, preferably the same material that the hull is made from. The diameter of the tunnel 104 will vary, depending upon the size of the boat 10 and the power output required for steering the boat 10. The diameter of the tunnel is preferably between sixteen and twenty-four inches. The tunnel 104, is open at both ends so that water may pass through from one side of the bow 28 to the other.

Figure 2:
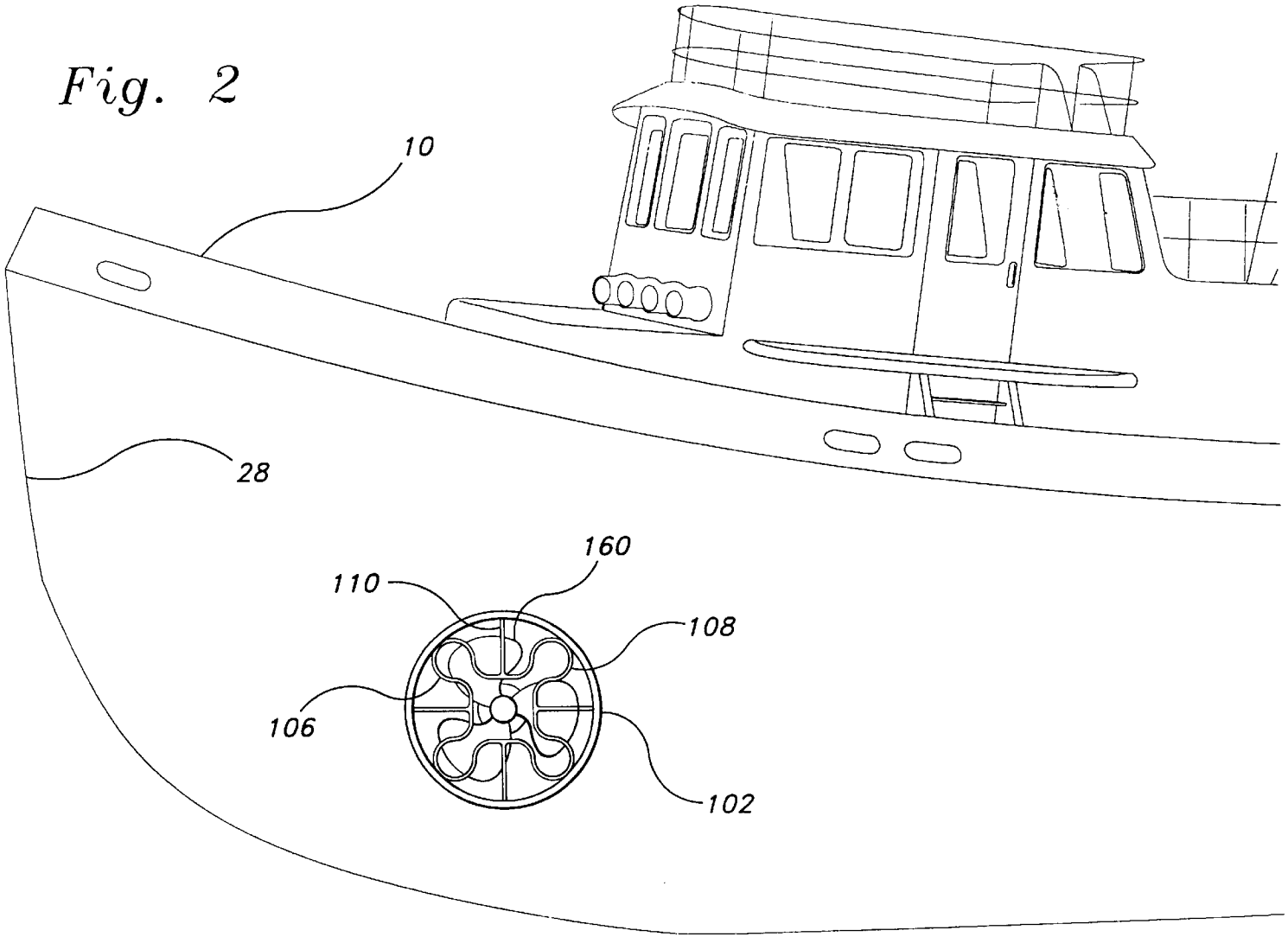
FIG. 2 is a fragmented elevational view of a boat equipped with a bow thruster according to the present invention as seen from the right side, the left side being symmetrical.

The propellers 160 are protected from fouling caused by debris in the water by stator screens 106 disposed within the tunnel 104 between the thruster 100 and the hull of the boat 10. It is well known in the art to protect the thruster propellers with a screen. The stator screen 106 of the present invention, however, has a novel design shown more particularly in FIG. 2, which results in a decreased resistance to the flow of water through the tunnel 104 while protecting the propellers 160 from flotsam, jetsam, and other debris. As shown in FIG. 2, the screens 106 are made from flat metal straps, preferably of NIBRAL (a nickel-bronze-aluminum alloy), and have the shape of a four-leaf clover in which the four leaves 108 are separated from each other by bars 110, the center of the screen 106 having a hollow square passage defined therein. The screens 106 are fixedly attached to the pipe 102 by bolting the apex of each leaf 108 to the pipe 102. The flat surfaces of the screens 106 act as stators to convert the rotational energy imparted to the water by the propellers 160 to a rectilinear, lateral thrust. The screens 106 are mounted about two inches from the propellers 160 inside the pipe 102, causing less resistance to water flow than conventional screens mounted to the hull externally.

Figure 3:
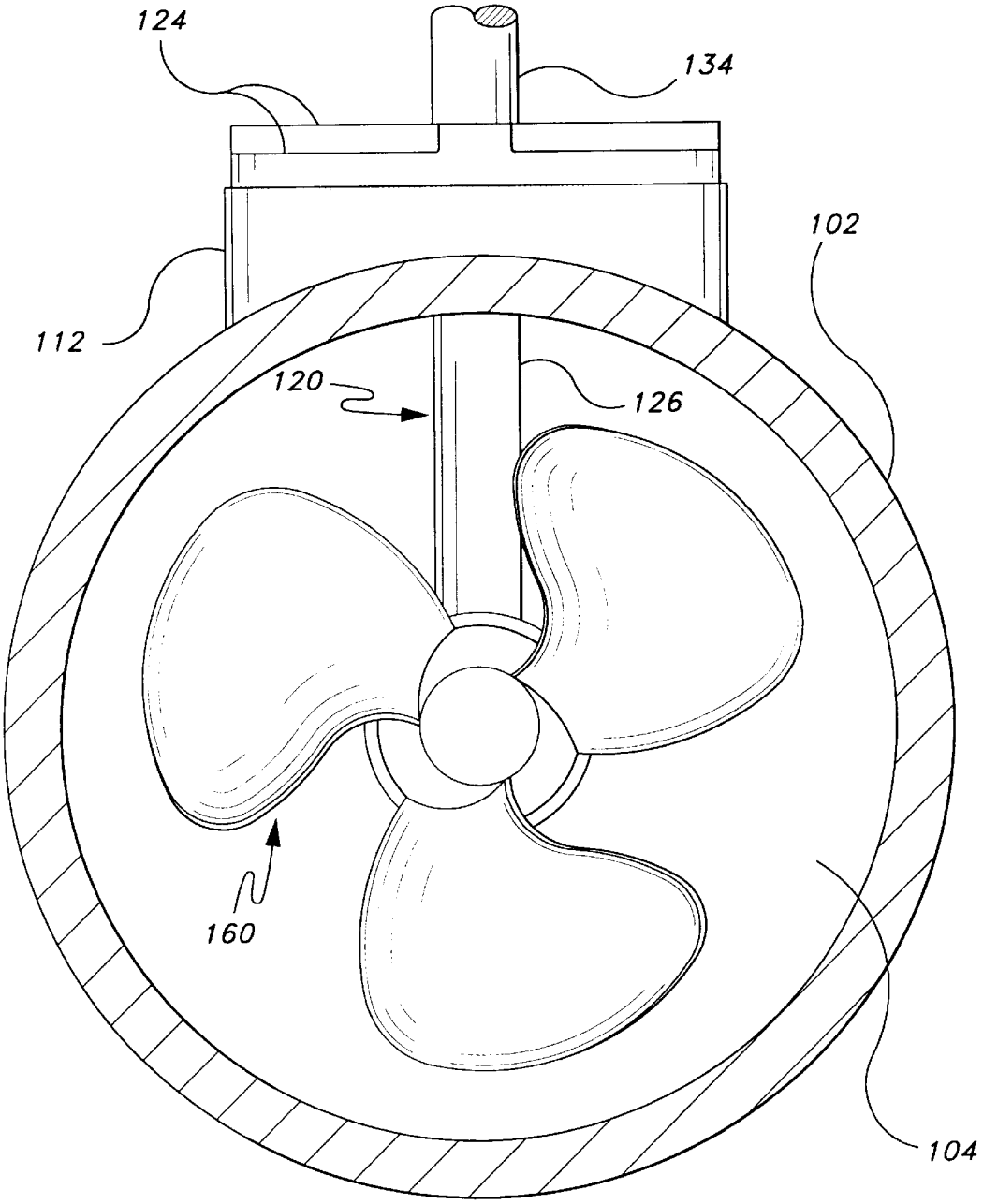
FIG. 3 is a section view along the line 3—3 of FIG. 1.
Figure 4:
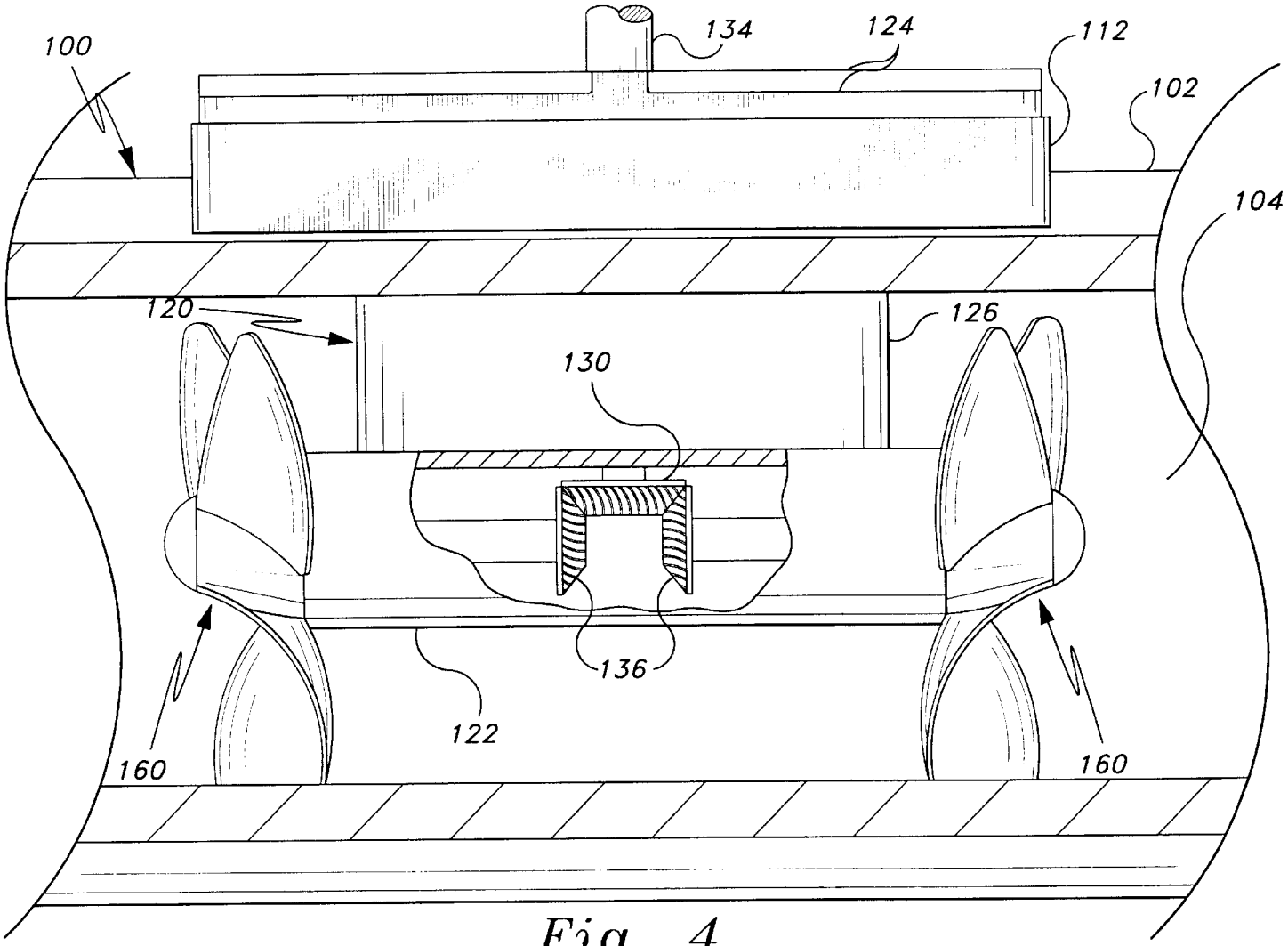
FIG. 4 is a partial section view taken longitudinally along, the length of the tunnel, the foot of the gearbox being partially broken away.
Figure 5:
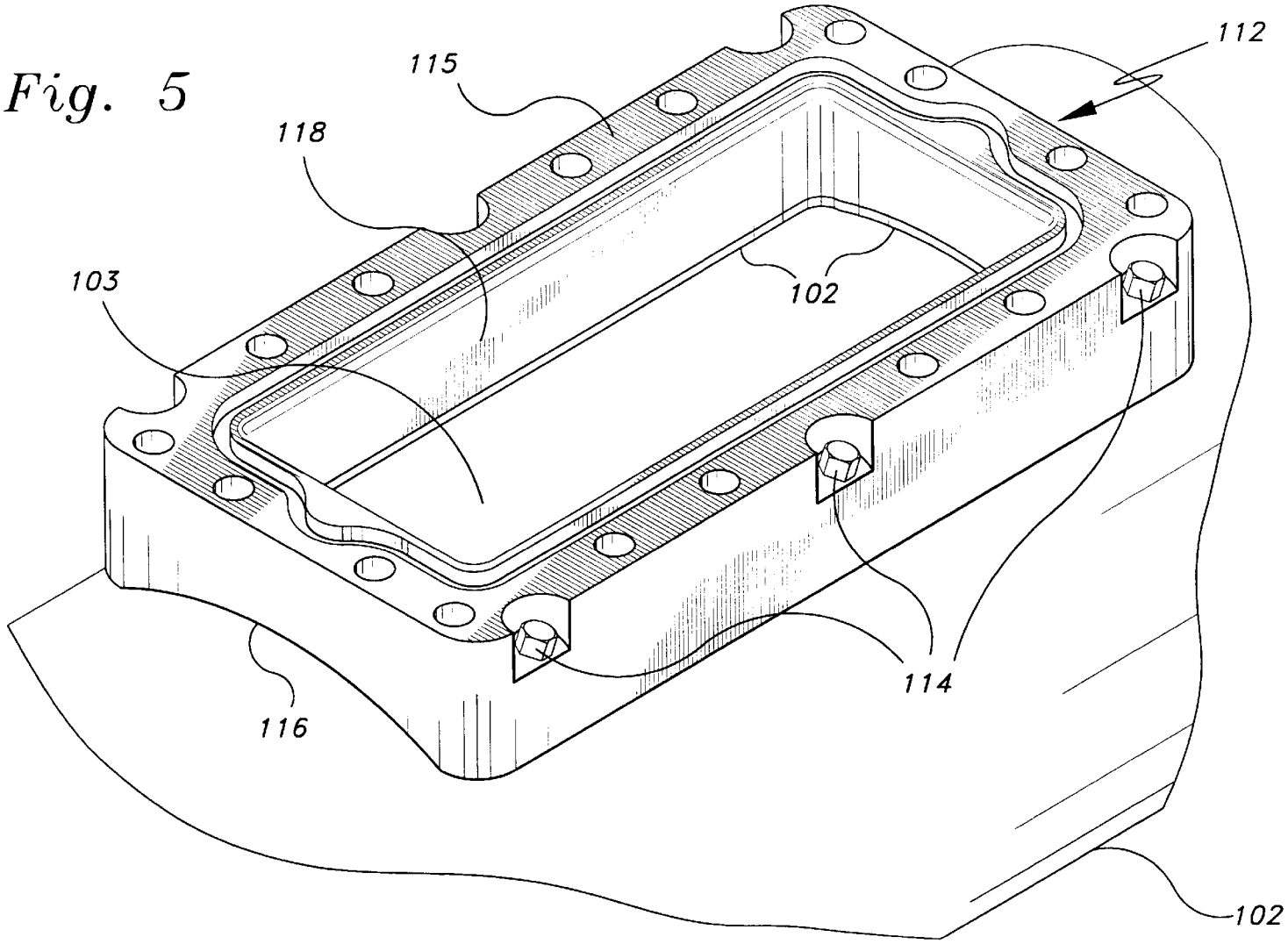
FIG. 5 is a perspective view of a tunnel flange of the bow or stern thruster according to the present invention.

As shown in FIGS. 3 and 4, the propellers 160 are connected to the foot 122 of a gearbox 120 which projects into the tunnel 104. The gearbox 120 is removably fastened to a tunnel flange 112 by appropriate fasteners, such as bolts. The tunnel flange 112 is shown more particularly in FIG. 5 with the gearbox 120 removed. The tunnel flange 112 is attached to the outside surface of the pipe 102 by a plurality of bolts 114. The tunnel flange 112 is a generally rectangular plate having a top surface 115 and a bottom surface 116. The bottom surface 116 is arcuately shaped, the radius of curvature of the bottom surface 116 of the tunnel flange 112 being the same as the radius of curvature of the pipe 102 in order to lie flush against the outside surface of the pipe 102. The top surface 115 is flat and has a plurality of threaded holes defined about its perimeter, the tunnel flange 112 being adapted to receive the gearbox flange 124. The center of the tunnel flange 112 has a rectangular hole 118 defined therein, the length and width of the hole 118 being slightly larger than the length and width of the foot 122 of the gearbox 120. The pipe 102 has a rectangular hole 103 defined in its wall, the holes 118 and 103 having the same dimensions. The tunnel flange 112 is bolted to the outside surface of the pipe 102 with the holes 118 and 103 registered so that the gearbox 120 may be inserted through the aligned holes 118, 103 into the tunnel 104, the gearbox flange 124 being firmly seated on the tunnel flange 112 and bolted thereto in order to form a watertight seal. The tunnel flange 112 is essentially left permanently mounted on the pipe 102 during installation, removal, and maintenance of the gearbox 120.

Figure 6:
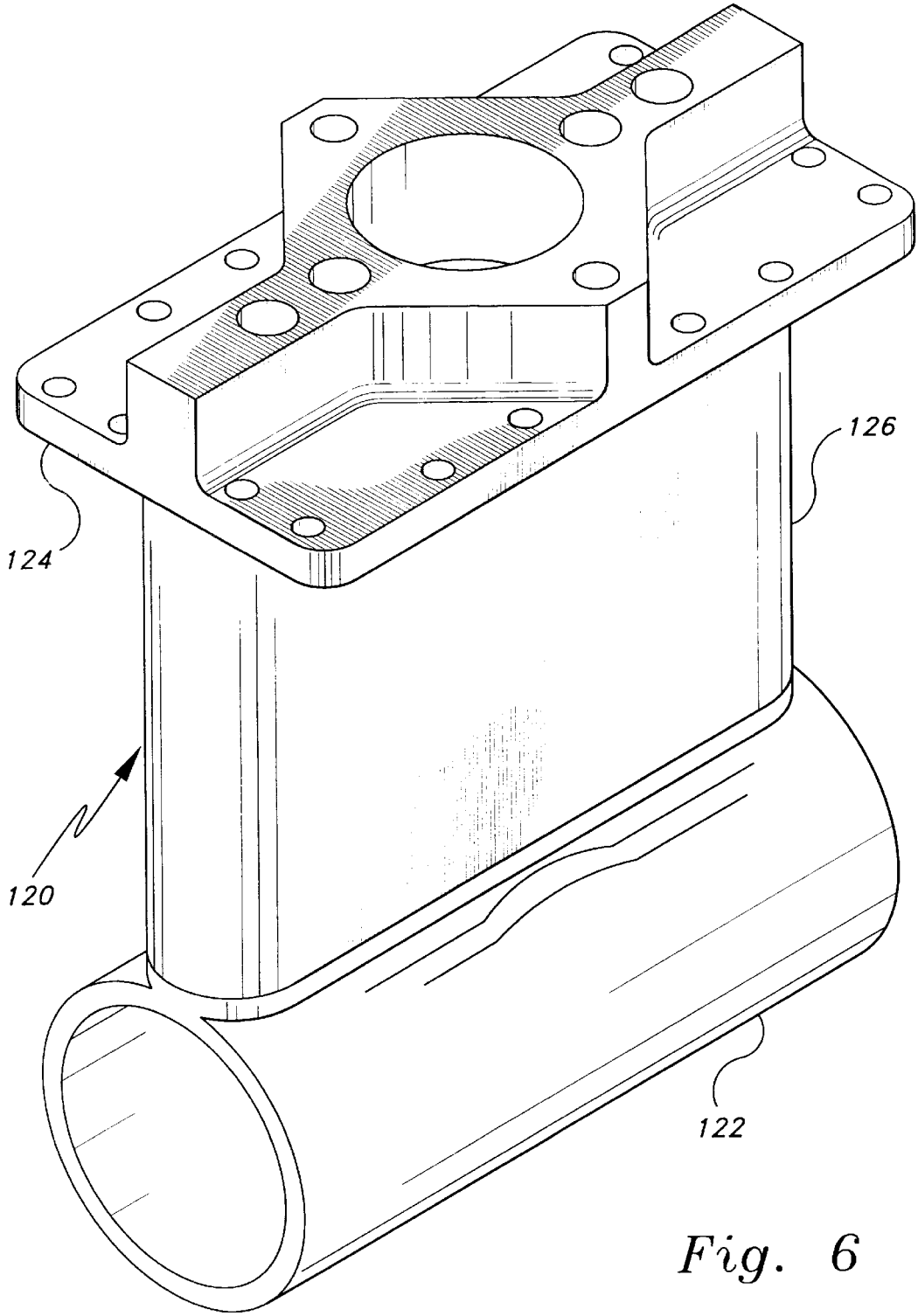
FIG. 6 is a perspective view of a gearbox of the bow or stern thruster according to the present invention.
Figure 7:
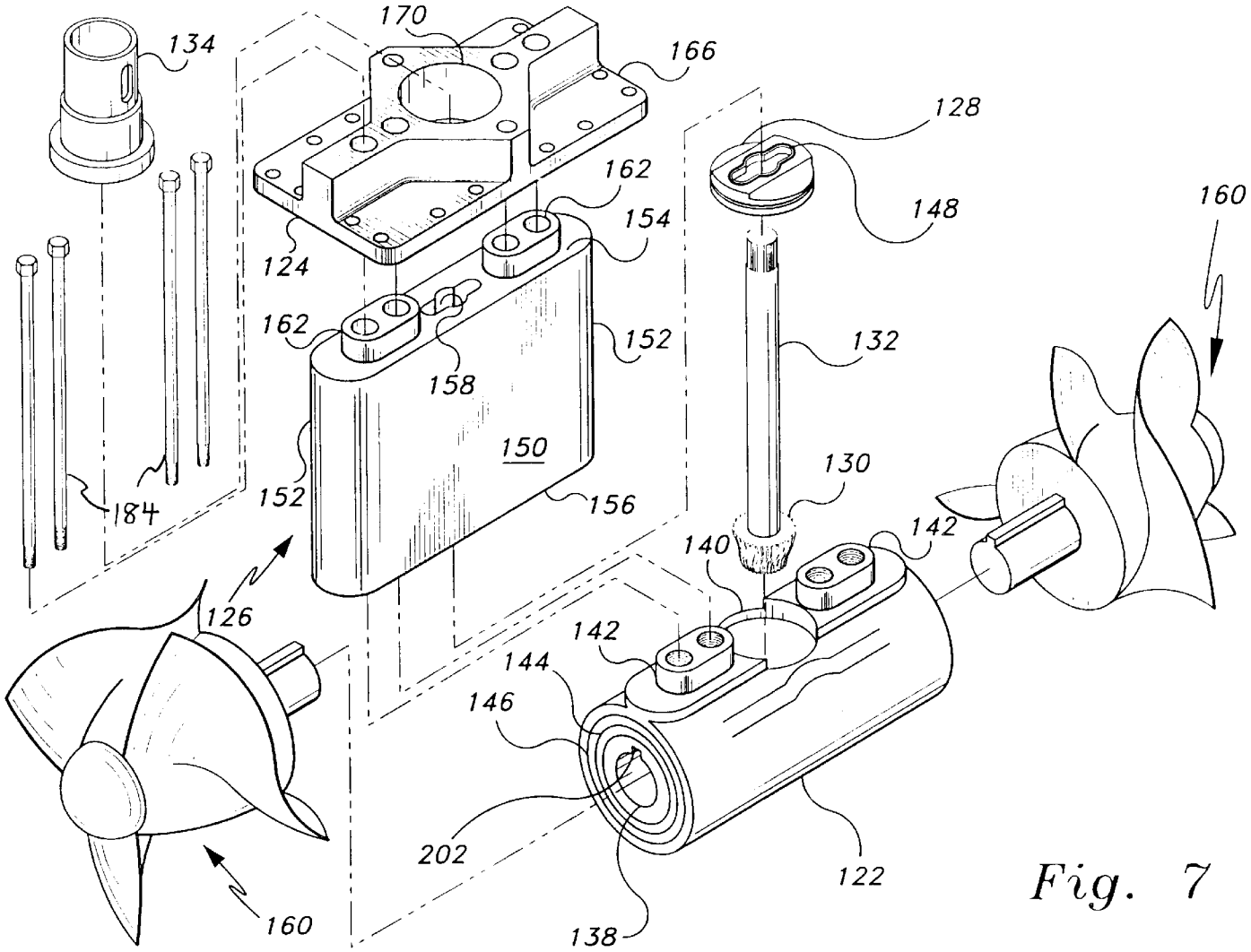
FIG. 7 is a perspective view of a gearbox of the bow or stern thruster according to the present invention exploded vertically.

As shown in FIGS. 6 and 7, the gearbox 120 comprises four components: a foot 122, a gearbox flange 124, a neck 126 and a foot cap 128. The gearbox 120 serves as a housing for a gear train which transmits power from the motor 20 to a pair of propeller shafts disposed at right angles to the motor shaft through a bevel gear arrangement. The gear train preferably includes a primary gear 130 mounted on a vertical gear shaft 132 which is coupled to the motor 20 by a conventional coupler 134, and two side gears 136 mounted on horizontal gear shafts 138 which drive the propellers 160. The gears 130, 136 are preferably spiral bevel gears coupled within the gearbox 120 as shown in the breakaway view of FIG. 4 in order to rotate the propellers 160 in opposite directions.

The gearbox foot 122 is a hollow cylinder open at both ends and having a generally circular opening 140 defined in its sidewall. The circular opening 140 has a diameter slightly larger than the diameter of the primary gear 130 so that the primary gear 130 may be inserted through the opening 140 during assembly of the thruster 100. The foot 120 includes a pair of raised bosses 142, the bosses 142 being longitudinally on the outer sidewall of the foot 122 on opposite sides of the opening 140 for a purpose, described below. The inside diameter of the foot 120 is greater than the diameter of the side gears 136, the shafts 138 being supported in the foot 122 by conventionally known roller bearings 144 and seals 146, such as O-rings. When the gear train is assembled within the gearbox 120, the horizontal shafts do not project beyond the ends of the foot 122, either being coplanar with the ends, or being slightly recessed within the foot 120. The foot 120 may have a second sealable opening (not shown) defined in its sidewall 180° opposite to the opening 140 in order to provide access for aligning the gears 130, 136 and for mounting a zinc anode for protection against corrosion, as is known in the art.

The foot cap 128 is disk-shaped plate having a diameter adapted for forming a watertight seal over the opening 140 in the foot 120 after the primary gear 130 has been inserted through the opening 140. The foot cap 128 has a bore 148 defined therein having a central portion with a diameter slightly larger than the diameter of the vertical shaft 132 so that the cap 128 slides over the shaft 132 during assembly, while during operation the shaft 132 is free to rotate within the bore 148.

The neck 126 is an elongate body having a pair of opposing outer sides 150, a pair of opposing ends 152, a top surface 154, and a bottom surface 156. The outer sides 152 are elongated and rectangular in shape, the overall length of the neck 126 being slightly less than the length of the foot 120. The ends 152 of the neck 126 are arcuate, being convex, the ends 152 providing the neck 126 with a width only slightly greater than the diameter of the vertical shaft 132 plus the thickness of the outer sides 150, the width of the neck 126 and the shape of the ends 152 being designed to present as small and streamlined an obstruction to the flow of water through the tunnel 104 as possible. In the preferred embodiment, the neck 126 may have a width of about two inches.

Advantageously, the length of the neck 126 permits the foot 122 of the gearbox 120 to be stably supported by a single support. The majority of prior art thrusters support the gearbox by a plurality of struts or vanes extending from the gearbox to the wall of the tunnel. This construction increases resistance to the flow of water through the tunnel, decreasing the efficiency of the thruster. Those prior art thrusters which support the gearbox by a single support generally use a cylindrical support slightly larger in diameter than the driving gear. The large diameter of the support presents a larger resistance to the flow of water through the tunnel than the narrow width of the neck 126 of the present invention, while at the same time providing inadequate support for the foot of the gearbox. Over a period of time, due to the stress caused by the torque of the gear train and wear of the gear faces, the foot tends to twist so that the propeller blades begin to scrape and bang noisily against the wall of the tunnel. The length of the sides 150 of the neck 126 of the present invention provide a stable, single support for the foot 122, the structure being better able to resist the torque of the gear train.

Figure 9:
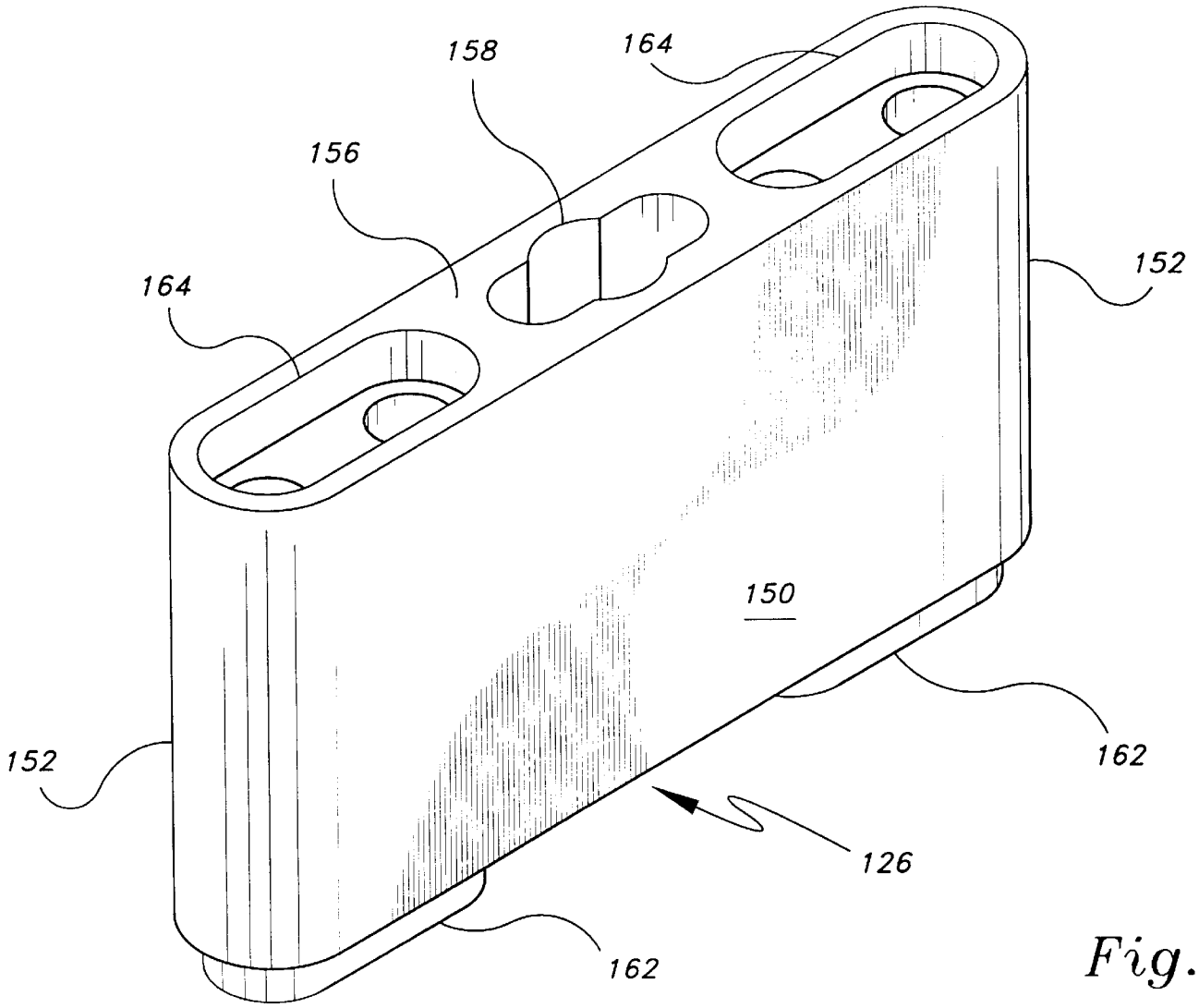
FIG. 9 is a bottom perspective view of the neck of the gearbox of the bow thruster according to the present invention.

The neck 126 has a cavity 158 defined therein extending from the top surface 154 through the bottom surface 156 (FIG. 9). The top surface 154 of the neck also includes a pair of raised bosses 162 disposed on opposite sides of the cavity 158 for a purpose described below. The bottom surface 156 of the neck 126 includes a pair of recesses 164 defined therein on opposite sides of the cavity 158, as shown more particularly in FIG. 9, the recesses 164 being adapted for receiving the bosses 142 on the sidewall of the foot 120 snugly, the cavity 158 being aligned with the opening 140 in the foot 120 so that the vertical shaft 132 may pass through the cavity 158 and rotate freely therein. The height of the neck 126 from the top surface 154 to the bottom surface 156 is such that the, neck 126 projects far enough into the tunnel 104 to support the foot 122 in the axial center of the tunnel 104.

The gearbox flange 124 is a flat, rectangular plate having about the same length and width as the tunnel flange 112, and having a plurality of holes defined about its perimeter which may be aligned with the threaded holes defined in the tunnel flange 112 so that the gearbox flange 124 may be placed flush atop the tunnel flange 112 and securely bolted thereto, the flat surfaces of the gearbox flange 124 and the top surface 115 of the tunnel flange 112 forming a watertight seal.

Figure 10:
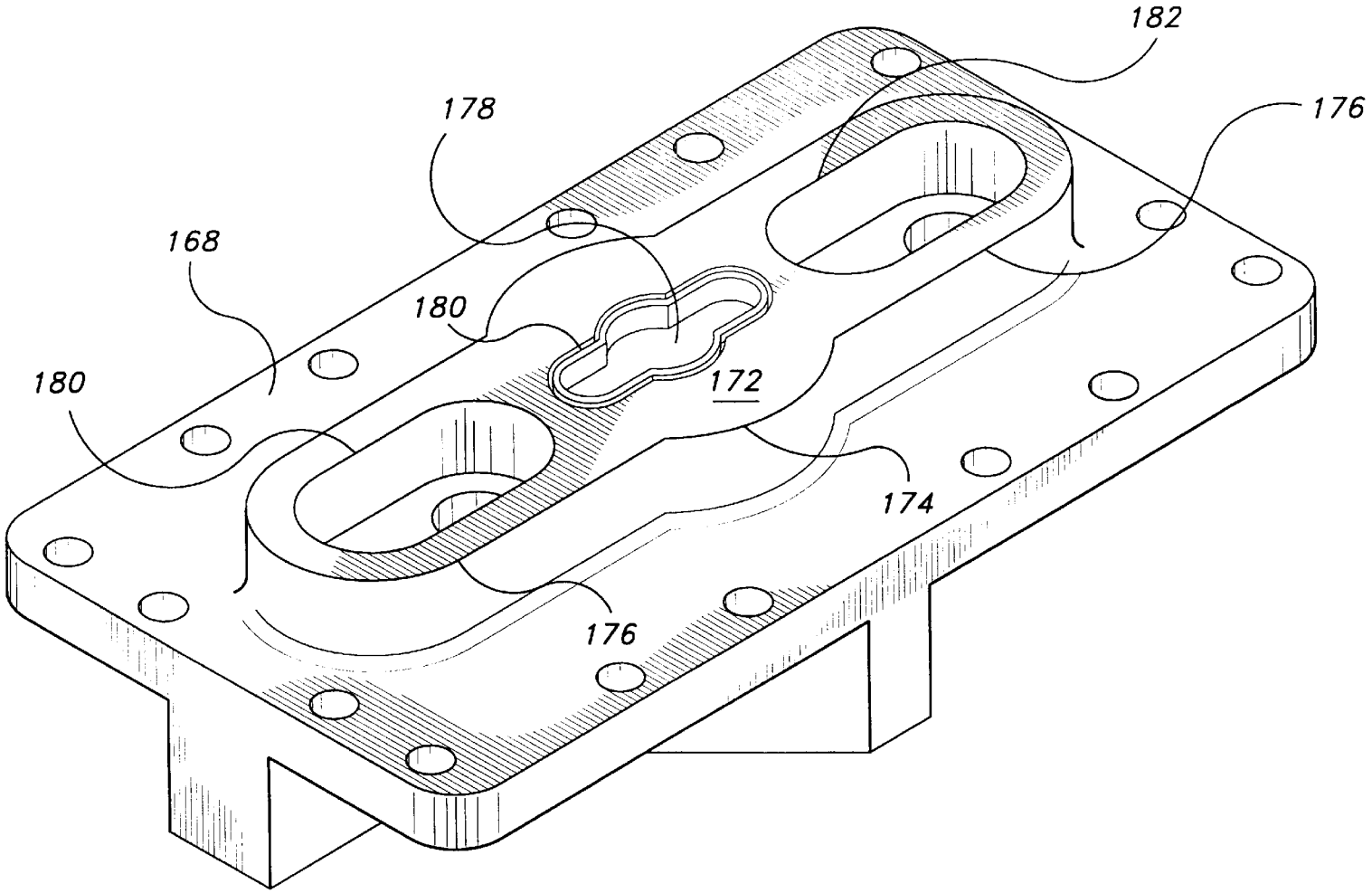
FIG. 10 is a bottom perspective view of the gearbox flange of the bow thruster according to the present invention.

The gearbox flange 124 has a top surface 166 and a bottom surface 168, the top surface 166 having a raised, generally cross-shaped projection on its surface 166, the arms of the cross extending to the edges of the plate. A cylindrical well 170 is defined in the center of the top surface 166. The bottom surface 168 of the flange 124, shown more particularly in FIG. 10, has a raised boss 172 projecting from its surface 168, the boss 172 having a circular center portion 174 and a pair of arms 176 projecting from the center portion 174 180° apart. The center portion 174 forms the bottom of the well 170, and has an opening 178 defined therein with a flange 180 depending from the edges of the opening 178, the flange 180 being adapted for fitting into the cavity 158 snugly in order to form a watertight seal between the cavity 158 and the well 170. The arms 176 have a pair of recesses 182 defined therein adapted to snugly receive the bosses 162 mounted on the top surface 154 of the neck 126.

When the thruster 100 is assembled, the free end of the vertical gear shaft 132 extends through the cavity 158, the opening 178 in the boss 172, and into the bottom of the well 170. The free end of the gear shaft 132 may be splined, and receives a coupler 134 in conventional fashion which may be partially disposed within the well 170. The gearbox 120 is assembled by inserted a plurality of elongated bolts 184 through bores defined in the gearbox flange 124, the bosses 162 on the top surface of the neck 126, and into threaded bores defined in the bosses 142 on the foot 122, the foot, cap 128 being previously inserted into the opening 140 in the foot 122.

Figure 8:
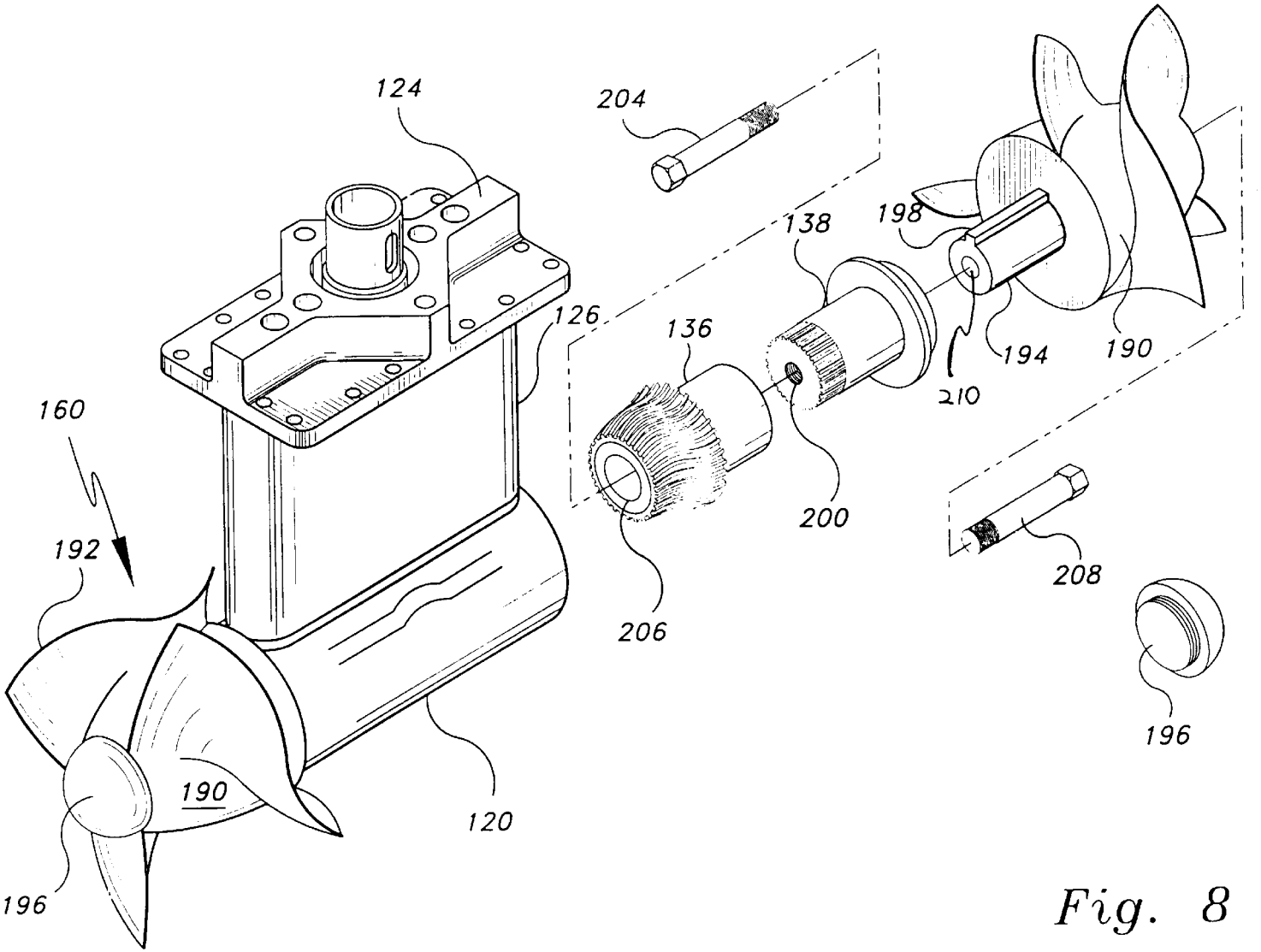
FIG. 8 is a perspective view of a gearbox of the bow or stern thruster according to the present invention exploded horizontally on one side with the propeller blades being removed from the hub for clarity, the other side being symmetrical.

The thruster 100 may be installed by assembling the gearbox 120 at any convenient location, and then inserting the foot 122 and neck 126 of the gearbox 120 through the aligned holes 118, 103 in the tunnel flange 112 and pipe 102, bolting the gearbox flange 124 to the tunnel flange 112, so that the foot 122 is disposed in the tunnel 104. The propellers 160 are then mounted to the ends of the horizontal shafts 138 on opposite ends of the foot 122, as shown more clearly in FIGS. 7 and 8.

Each propeller 160 includes a propeller hub 190, a plurality of blades 192, and a propeller shaft 194 integral with the hub 190. The end of the hub 190 opposite the shaft 194 has a removable propeller cap 196 threadably fastened to the hub 190. The propeller shaft 194 includes a key 198. The horizontal gear shaft 138 has a bore 200 defined therein, the bore 200 having a first section with a wide diameter facing the hub 190, and a second section having a narrow diameter facing the side gear 136. The propeller shaft 194 is slidably inserted into the first section of the bore 200, the key 198 aligning with a keyway 202 defined in the bore 200, so that the propeller shaft rotates with the gear shaft 138.

The second section of the bore 200 is doubly threaded. A first bolt 204 is inserted through a bore 206 defined in the side gear 136 and threadably engages the second section of the bore 200 in the gear shaft 138 to secure the gear 136 to the shaft 138. A second bolt 208 is inserted through a bore 210 defined in the propeller shaft 194 and threadably engages the second section of the bore 200 defined in the horizontal gear shaft 138 in order to secure the propeller 160 to the shaft 138. The side gear 136 itself is secured in the foot 122 by conventional bearings (not shown).

It will be apparent from this description that the thruster 100 may be removed from the boat 10 for routine maintenance services without removing the boat 10 from the water. A diver may unbolt the screens 106 from the pipe 102. The diver then unscrews the propeller caps 196 from the hubs 190 to gain access to a recessed area in the hub 190. The bolts 208 are then removed and the propeller shafts 194 are slidably removed from the horizontal gear shafts 138. Tunnel plugs, which are well known in the art, are applied to opposite ends of the tunnel 104 to block the flow of water through the tunnel 104. From inside the boat 10, the gearbox flange 124 is unbolted from the tunnel flange 112, the gearbox 120 may be removed from the tunnel 104, a flat plate (not shown) may be bolted to the tunnel flange 112 to make the pipe 102 watertight, and the plugs may be removed. The unit may then be lubricated, painted, or otherwise serviced.

All parts of the thruster 100 exposed to the water are made from corrosion resistant material. The gearbox 120 and pipe 102 are preferably made from stainless steel. The propellers 160 are preferably made from NIBRAL (a nickel-bronze-aluminum alloy). The thruster 100 may be treated with a corrosion resistant coating, such as paint.

Operation of the thruster 100 should be self-evident from the foregoing description. The operator of the boat 10 may operate the thruster 100 from the controls 22 in the cockpit 12 to direct a sideways flow of water through the tunnel 104 to provide lateral steering as needed in narrow waterways or to maintain the boat's position against strong winds or current.

It is to be understood that the present invention is not limited to the embodiments described above, but encompasses any and all embodiments within the scope of the following claims.

I claim:

1. A bow or stern thruster for auxiliary steering of a waterborne vessel having a bow, a stern, a port side and a starboard side, the thruster comprising:

a) a pipe extending across the bow or stern of a waterborne vessel from the port side to the starboard side, the pipe having opposing ends and a sidewall, the sidewall having an opening defined therein, the pipe being open at both ends and defining a tunnel across the vessel;

b) a tunnel flange fastened to said pipe outside of said tunnel, the flange having an opening defined therein aligned with the opening in said pipe;

c) a gearbox removably fastened to said tunnel flange and extending into said tunnel;

d) a gear train disposed within said gearbox, the gear train including:

i) a primary gear mounted on a vertical gear shaft, the shaft having a removable coupler adapted for connection to a means for driving said primary gear; and ii) a first side gear and a second side gear, the side gears being driven by said primary gear, the first side gear being mounted on a first horizontal gear shaft having a free end directed towards the port side of the vessel, the second side gear being mounted on a second horizontal gear shaft having a free end directed towards the starboard side of the vessel;

e) a first propeller and a second propeller, the first propeller being connected to the free end of said first horizontal gear shaft, the second propeller being connected to said second horizontal gear shaft; and f) wherein said horizontal gear shafts are entirely disposed within said gearbox, said gearbox having a length and a width slightly smaller than the opening in said pipe and the opening in said tunnel flange, so that said gearbox may be extended into and removed from said tunnel from inside the vessel when said propellers are disconnected from said horizontal gear shafts.

2. The bow or stern thruster according to claim 1, further comprising a first stator screen and a second stator screen, the stator screens being attached to the sidewall of said pipe, the first stator screen being disposed within said tunnel between said first propeller and an open end of said pipe, the second stator screen being disposed within said tunnel between said second propeller and an open end of said pipe.

3. The bow or stern thruster according to claim 2, wherein said stator screens are made from flat metal straps and have the shape of a four-leaf clover, each of the leaves being separated from its neighbors by a metal bar, the center of the screens having a hollow, square passage defined therein.

4. The bow or stern thruster according to claim 1, wherein said tunnel flange comprises a substantially rectangular plate having a flat top surface and an arcuately shaped bottom surface, the radius of curvature of the bottom surface being about the same as the radius of curvature of said pipe so that said bottom surface fits flush against said pipe, forming a watertight seal between said tunnel flange and said pipe.

5. The bow or stern thruster according to claim 1, wherein said gearbox comprises:

a) a hollow, cylindrical foot having a first end, a second end, and a sidewall, the ends being open, the sidewall having a substantially circular opening defined therein, the diameter of the opening being slightly larger than the diameter of said primary gear, the inside diameter of said foot being greater than the diameter of said side gears;

b) a foot cap, the foot cap being a disk-shaped plate having a diameter adapted for forming a watertight seal in the opening in said foot;

c) a neck with a body having a pair of substantially rectangular, elongated, opposing sides, a pair of arcuately shaped ends, a top surface, and a bottom surface; and d) a gearbox flange, the gearbox flange being removably fastened to said tunnel flange, said foot, said foot cap, said neck, and the gearbox flange being removably fastened together.

6. The bow or stern thruster according to claim 5, wherein:

a) said foot cap has a bore defined therein;

b) neck has a cavity defined through the neck between the top surface and the bottom surface of said neck;

c) said gearbox flange has a top surface and a bottom surface, a circular well being in the center of said top surface, the bottom surface having a raised boss forming the bottom of the well with an opening defined therein; and d) said primary gear is disposed within said foot, said vertical gear shaft extending through the bore defined in said foot cap, the cavity defined in said neck, and the opening in said gearbox flange, the coupler being attached to said vertical gear shaft in the cylindrical well.

7. The bow or stern thruster according to claim 1, wherein each of said propellers further comprise:

a) a hub having a bore defined therein;

b) a plurality of blades attached to said hub;

c) a propeller shaft integral with said hub, the shaft having a key and having a bore defined therein; and d) a propeller cap removably attached to said hub.

8. The bow or stern thruster according to claim 7, wherein:

a) said horizontal gear shaft has a bore defined therein, the bore including a keyway and being threaded for at least a portion of its length;

b) said propeller shaft is slidable into the bore defined in said horizontal gear shaft, the key being aligned in said keyway so that said propeller shaft rotates with said horizontal gear shaft but does not rotate with respect to the bore.

9. The bow or stern thruster according to claim 8, wherein each of said propellers further comprises a bolt extending through the bore defined in said hub, the bore defined in said propeller shaft, and fastening in the bore defined in said horizontal gear shaft in order to fasten said propeller to one of said side gears, the bolt being covered by said propeller cap.

10. The bow or stern thruster according to claim 1, wherein said tunnel flange and said gearbox are made from stainless steel.

11. The bow or stern thruster according to claim 1, wherein said propellers are made from a metal alloy containing nickel, bronze, and aluminum.

12. The bow or stern thruster according to claim 1, wherein said primary gear and said side gears are spiral bevel gears.

13. A gearbox for use with a bow or stern thruster for auxiliary steering of a waterborne vessel, comprising:

a) a hollow, cylindrical foot having a first end, a second end, and a sidewall, the ends being open, the sidewall having a substantially circular opening defined therein, the diameter of the opening being adapted for receiving a primary gear, the inside diameter of said foot adapted for receiving a side gear;

b) a foot cap, the foot cap being a disk-shaped plate having a diameter adapted for forming a watertight seal in the opening in said foot;

c) a neck with a body having a pair of substantially rectangular, elongated, opposing sides, a pair of arcuately shaped ends, a top surface, and a bottom surface; and d) a gearbox flange, the gearbox flange adapted for being removably fastened to a tunnel flange, said foot, said foot cap, said neck, and the gearbox flange being removably fastened together.

14. The gearbox according to claim 13, wherein:

a) said foot cap has a bore defined therein;

b) neck has a cavity defined through the neck between the top surface and the bottom surface of said neck;

c) said gearbox flange has a top surface and a bottom surface, a circular well being in the center of said top surface, the bottom surface having a raised boss forming the bottom of the well with an opening defined therein; and d) said gearbox is adapted for receiving a primary gear disposed within said foot and a vertical gear shaft extending from said foot through the bore defined in said foot cap, the cavity defined in said neck, and the opening in said gearbox flange.

15. The gearbox according to claim 14, wherein said gearbox flange further comprises a flange depending from the perimeter of the opening defined in the bottom of the cylindrical well, the flange forming a watertight seal with the cavity defined in said neck.

16. The gearbox according to claim 14, wherein:

a) said foot further comprises a raised boss disposed on the outside of the sidewall on opposite sides of said opening, each boss having at least one threaded bore defined therein;

b) the top surface of said neck further comprises a raised boss on opposite sides of said cavity, each boss having a least one bore defined therein, the bottom surface of said neck having a pair of recesses defined therein adapted for snugly receiving the bosses on said foot;

c) the raised boss on the bottom surface of said gearbox flange further comprises a pair of arms extending on opposite sides of the cylindrical well, each of the arms having a recess defined therein for snugly receiving the raised boss on the top surface of said neck, said gearbox flange having at least one bore extending through each recess; and d) said gearbox further comprises a plurality of bolts extending through the bores defined in said gearbox flange, the bosses on the top surface of said neck, and being removably fastened in the bores defined in the bosses on said foot.

17. A propeller in combination with a side gear mounted on a horizontal gear shaft disposed entirely within a gearbox of a bow or stern thruster for auxiliary steering of a waterborne craft, comprising:

a) a propeller hub having a bore defined therein;

b) a plurality of blades attached to said hub;

c) a propeller shaft integral with said hub, the shaft having a key and having a bore defined therein; and d) a propeller cap removably attached to said hub.

18. The propeller in combination with a side gear according to claim 17, wherein:

a) the horizontal gear shaft has a bore defined therein, the bore including a keyway and being threaded for at least a portion of its length;

b) said propeller shaft is slidable into the bore defined in said horizontal gear shaft, the key being aligned in said keyway so that said propeller shaft rotates with the horizontal gear shaft but does not rotate with respect to the bore.

19. The propeller in combination with a side gear according to claim 17, wherein said propeller further comprises a bolt extending through the bore defined in said hub, the bore defined in said propeller shaft, and fastening in the bore defined in the horizontal gear shaft in order to fasten said propeller to the side gear, the bolt being covered by said propeller cap.

* * * * *